United States Patent [19]

Yamasaki

[11] Patent Number: 4,947,833

[45] Date of Patent: Aug. 14, 1990

[54] BED-TYPE ROLLER MASSAGING MACHINE

[75] Inventor: Yoshikiyo Yamasaki, Osaka, Japan

[73] Assignees: Kabushiki Kaisha Fuji Iryoki, Osaka; Kabushiki Kaisha Japan Health, Sakai, both of Japan

[21] Appl. No.: 289,904

[22] Filed: Dec. 23, 1988

[51] Int. Cl.[5] ..... A61H 15/00

[52] U.S. Cl. ..... 128/52; 128/58

[58] Field of Search ..... 128/52, 58, 57, 51, 128/53

[56] References Cited

U.S. PATENT DOCUMENTS

| | | | |
|---|---|---|---|
| 2,577,646 | 12/1951 | Cameron | 128/58 |
| 3,446,205 | 5/1969 | Minohara | 128/57 |
| 3,794,018 | 2/1974 | Repko | 128/58 |
| 3,830,233 | 8/1974 | Hill | 128/57 |
| 4,373,516 | 2/1983 | Masuda et al. | 128/57 |
| 4,570,617 | 2/1986 | Baus | 128/52 |
| 4,656,998 | 4/1987 | Masuda et al. | 128/57 |
| 4,662,362 | 5/1987 | Masuda et al. | 128/33 |

FOREIGN PATENT DOCUMENTS

| | | | |
|---|---|---|---|
| 3018828 | 11/1981 | Fed. Rep. of Germany | 128/52 |
| 56-95049 | 8/1981 | Japan . | |
| 57-17655 | 1/1982 | Japan . | |
| 59-189851 | 10/1984 | Japan . | |
| 61-90664 | 5/1986 | Japan . | |

*Primary Examiner*—Edgar S. Burr
*Assistant Examiner*—Tonya Lamb
*Attorney, Agent, or Firm*—Flynn, Thiel, Boutell & Tanis

[57] ABSTRACT

A bed-type massaging apparatus having an elongate frame with a middle hinge so that the frame divides the bed into two parts which can be folded one over onto the other. A pair of roller-type massaging devices are supported on each of the frame halves and include rollers which extend transversely of the bed. Rotatable drive shafts extend transversely adjacent opposite ends of the bed and have drive wheels on the ends thereof joined together by endless driving belts or chains which extend longitudinally along opposite sides of the bed. These chains join to carriages associated with the massaging devices so that the massaging devices can be simultaneously moved in a pattern whereby they are simultaneously moved inwardly toward the center of the bed and then outwardly away from the center of the bed. A single drive motor is provided for driving one of the shafts.

5 Claims, 4 Drawing Sheets

BED-TYPE ROLLER MASSAGING MACHINE

FIELD OF THE INVENTION

The present invention relates to a bed-type roller massaging machine capable of being used as a bed or as a machine for massaging the whole body.

BACKGROUND OF THE INVENTION

As to conventional bed-type roller massaging machines, such machines which couple the parts of the bed frame to permit folding in half, so that it is not bulky for convenient transporting and storing, are already known. This conventional bed-type massaging machine has a massaging device provided with a screw drive and a motor associated with each of the upper half and lower half of the bed, whereby the respective motor moves its own massaging device. However, these known bed-type massaging machines hence require two motors and two screw drives and are of high cost.

While other known bed-type massaging machines have permitted the massaging devices for the upper half and the lower half to be driven by one motor and one screw drive, nevertheless the massaging machine can be folded only after moving the massaging device from the upper or the lower half and putting it in the storage stand on the side of the driving device.

Thus, the bed-type massaging machine of the invention permits each roller, equipped in the head part and the foot part of the bed, to be relatively moved toward and away from each other, or to be moved toward or away from the center of the bed, by driving a single motor, and it is possible to massage the whole body by only one motor.

Accordingly, the purpose of the invention is to furnish a bed-type roller massaging machine which has a low production cost, and which makes it possible to massage the upper and the lower half of the body by use of only a single motor. Moreover, the purpose of the invention is to provide a bed-type roller massaging machine which is possible to fold easily at the center of the main body into a compact size, making it possible to decrease transportation cost and space.

Another purpose of the invention is to provide a bed-type roller massaging machine which is possible to make each roller, constructed in the upper or lower part, be in contact with and separate from each other, or move to or from the center of the bed main, and which is possible to massage especially the waist.

DETAILED DESCRIPTION

Figure 1:
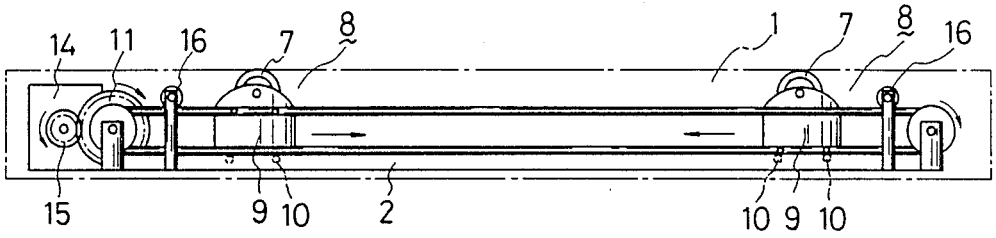
FIG. 1 is the side view which shows the inside mechanism of the invention.
Figure 2:
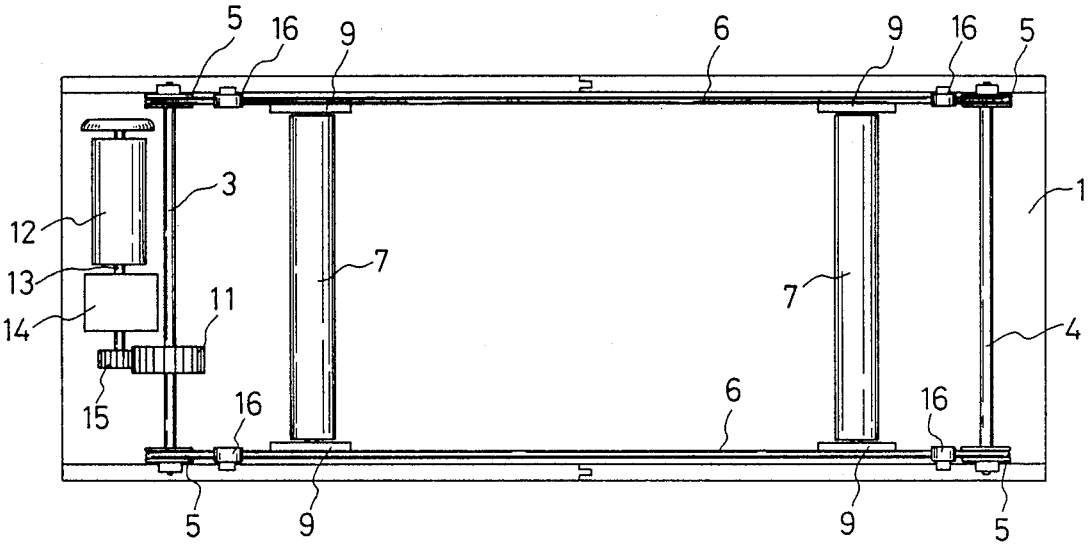
FIG. 2 is the plan view of FIG. 1.
Figure 3:
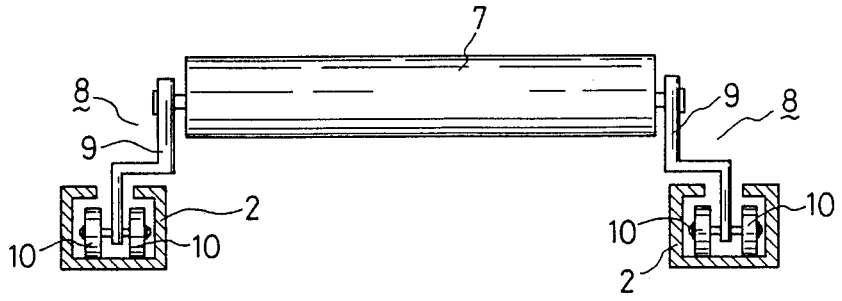
FIG. 3 shows the maintaining condition of the roller movable around the shaft in the invention.

Represented at 1 is a bed according to the present invention which can be folded in half substantially about its transverse centerline so as to be divided into two parts such as upper and lower halves (which parts also represent the head part and the foot part of the bed). The bed has a pair of generally parallel rails 2 which extend longitudinally of the bed adjacent opposite sides thereof. These rails are of an upwardly opening U- or channel-shaped cross section as shown in FIG. 3. Further, each rail 2 is longitudinally divided into elongate first and second rail parts 2*a* and 2*b* as illustrated in FIGS. 1, 2, 6, 7, 8 and 9. The rail parts 2*a* and 2*b* of each rail are generally aligned when the bed is in an open condition, and the adjacent inner ends of these rail parts are joined together by a hinge pin or screw 2' which defines the transverse centerline or hinge axis so that it is possible to fold the bed as shown in FIG. 9.

Rotary shafts 3 and 4 are located adjacent opposite ends of the bed and extend transversely thereacross for support adjacent the opposite ends of the rails 2. More specifically, the rails have brackets thereon adjacent the ends thereof, which brackets rotatably support the transversely extending shafts 3 and 4. These shafts have drive wheels 5 such as pulleys or gears mounted thereon adjacent opposite ends thereof. An endless drive member such as a belt 6 (FIG. 6) or a chain 6' (FIG. 8) extends between and is drivingly engaged with the pair of pulleys 5 disposed adjacent each side of the bed so that the shafts 3 and 4 are drivingly coupled together.

A reversible drive motor 12 is disposed adjacent one end of the bed and its drive shaft 13 rotatably drives a reduction gear mechanism 14, and it in turn has a drive gear 15 as its output. This drive gear 15 in turn drives a driven gear 11 which is secured to the shaft 3.

The bed 1 also includes a pair of massaging devices each including an axially-elongate roller 7 which is of generally cylindrical construction and extends transversely across substantially the full width of the bed. One of the rollers 7 is associated with each of the upper and lower parts of the bed. The pair of rollers 7 is disposed so that the rotational axes of the rollers are generally horizontal and parallel to one another, and extend perpendicularly with respect to the longitudinal direction of the bed. The opposite ends of each roller 7 are rotatably supported on a pair of carriers or carriages 8, such as by an intermediate shaft. These carriages are movably supported for displacement longitudinally along the side rails 2. Each carriage 8 includes a generally Z-shaped support having an upper leg part on which the support shaft of the roller 7 is supported. The support 9 has a lower leg part which projects downwardly into the channel-shaped rail 2, and is provided with two longitudinally-spaced pairs of rollers 10 thereon which provides for stable but rolling engagement of the carrier 8 within the respective side rail 2. The pair of rollers 7 are disposed so that they are substantially equally spaced from the transverse centerline of the bed.

Each of the carriers 8 is also joined to the chain 6' or belt 6 so as to be driven thereby along the respective side rail 2. For example, when the chain 6' is utilized, the support 9 can be joined to a pair of the hinge pins associated with the chain 6', or by use of a conventional fastening element which joins a pair of links to the support member 9. Similarly, when the belt 6 is utilized, each support 9 can be joined to the belt at two longitudinally-spaced locations, such as by coupling elements as indicated at 9*a* in FIG. 9. The carriers 8 adjacent one end of the bed are joined to the upper reach of the belt or chain, whereas the carriers 8 adjacent the other end of the belt are joined to the lower reach of the belt or chain, whereby the rollers 7 as associated with the upper and lower parts of the bed will hence always be moved in opposite directions, such as either inwardly toward one another or outwardly away from one another, depending on the rotational driving direction of the shaft 3.

Figure 6:
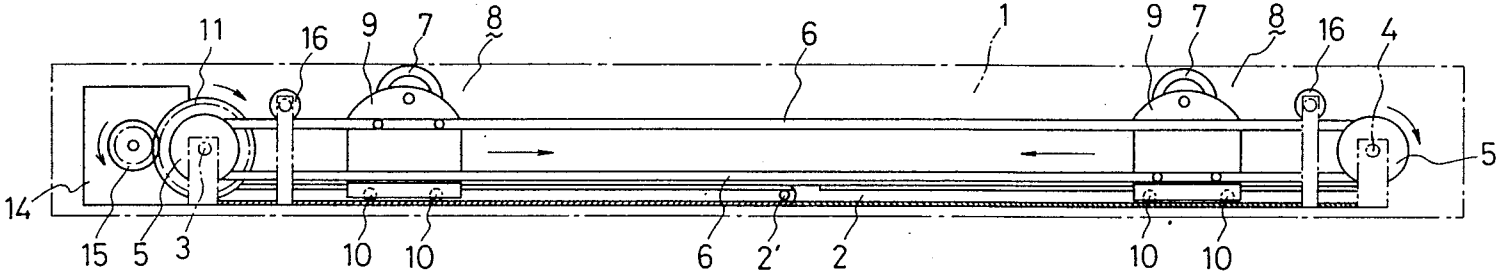
FIG. 6 is an enlarged vertical section which shows a preferred example of the inside mechanism of the bed-type roller massaging machine.
Figure 7:
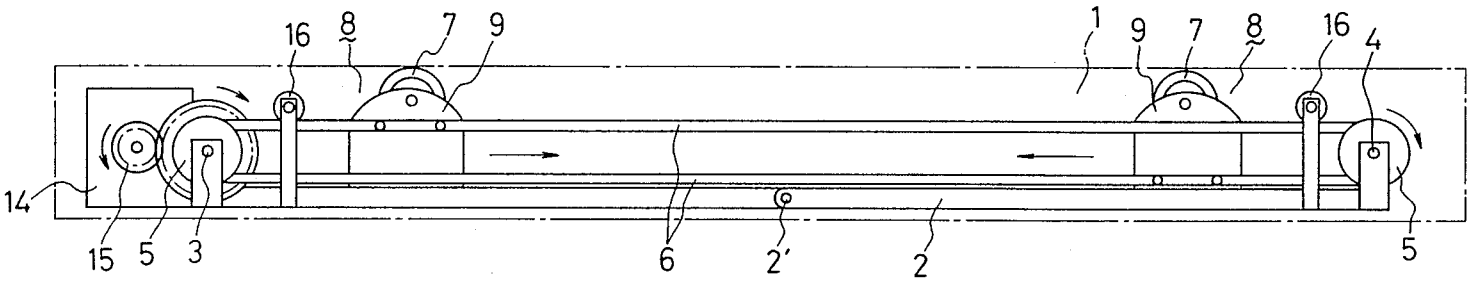
FIG. 7 is an enlarged side view which shows the executed example of the inside mechanism of the bed-type roller massaging machine.
Figure 8:
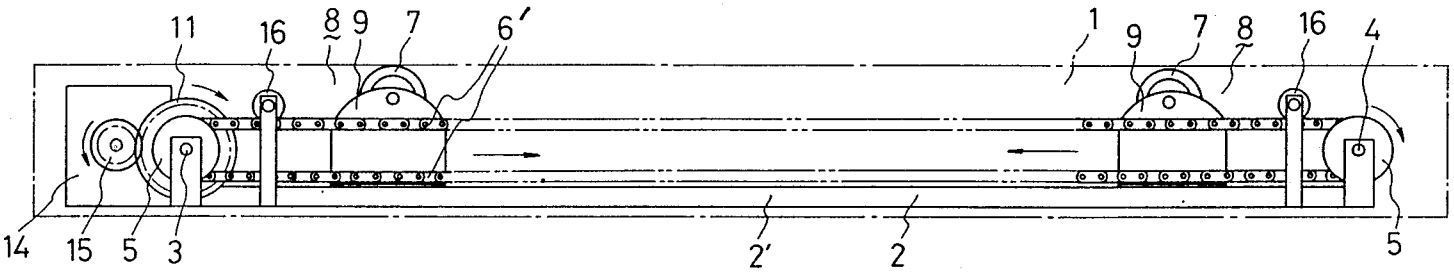
FIG. 8 is an enlarged side view which shows the executed example of the inside mechanism of the bed-type roller massaging machine using a endless chain.
Figure 9:
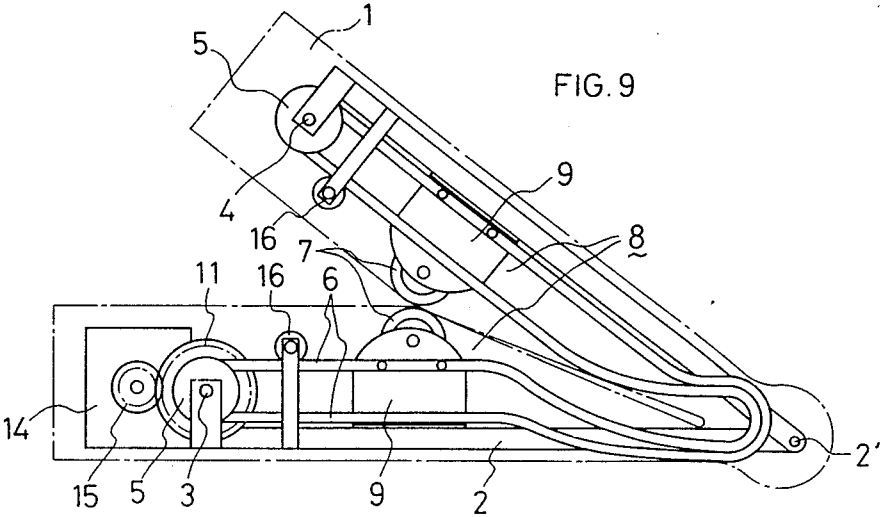
FIG. 9 is the explanatory figure which shows the folded condition of the bed-type roller massaging machine.

In operation, the motor 12 is energized to effect rotational driving of the shaft 3 such as in the direction indicated by FIGS. 6-8. This in turn causes driving movement of the endless flexible driving members 6 or 6' so that the pair of rollers 7 and their associated carriages, which are originally adjacent the opposite ends of the bed, are hence moved linearly inwardly toward one another and toward the centerline of the bed. When the pair of rollers 7 are disposed closely adjacent one another in close proximity to the centerline of the bed, then the rotational direction of the drive is reversed, such as by using a reversible drive motor 12. This reversal can be accomplished by means of an appropriate limit switch (not shown) which senses the innermost or centermost position of the carriages 8 and hence reversely energizes the drive motor. This reversed rotation of the drive motor hence reversely drives the endless drive members 6 or 6', and the rollers 7 and their associated carriages 8 are thus moved outwardly away from one another back toward their original end positions substantially as illustrated by FIGS. 6-8. Upon reaching the end position, an appropriate limit switch (not shown) can again cause reversal in the rotational direction so that the massaging devices can be alternatively moved inwardly toward and outwardly away from one another. A suitable manual shut-off switch can be provided for de-energizing the motor when desired.

During the above operation, a person lying face-up on the bed can have various parts of his body massaged by the free rotation of the rollers 7 as they are reciprocated back and forth between the ends and the center of the bed. For example, as the rollers 7 are moved inwardly toward the center of the bed, and thence returned outwardly, the rollers are capable of rollingly contacting and massaging the muscles of the back, the waist, and the legs of the user, with this massaging action being repetitive by permitting the rollers to repetitively move inwardly and outwardly along the longitudinal direction of the bed.

The bed, as is well known, is provided with a flexible covering which extends over the upper surface thereon, particularly over the rollers, and is secured relative to the frame to hence permit the user to lie thereon.

When the bed is not in use, it is possible to fold the bed about the axis defined by the pins or screws 2', substantially as illustrated by FIG. 9, for compact storage and handling. Further, when in this folded condition, wherein the one end part lies substantially over the other end part of the bed, the endless driving elements 6 or 6' still maintain proper engagement with the pulleys 5 since the weight of the carriages 8 and their coupling to the chain or belt hence maintains the chain or belt in tight engagement with the pulley 5, this being illustrated by FIG. 9. Further, a suitable holding roller 16 is preferably disposed in engagement with the upper surface of the upper reach of the endless driving element adjacent each of the pulleys 5 to further assist in holding the endless driving element in engagement with the pulley, such as when in the folded condition illustrated by FIG. 9. Hence, even when the bed is folded, the endless driving element associated with the folded end part of the bed does not lose driving engagement from its respective pulley 5.

The endless chains or belts hence, during folding of the bed, will become loose only in the intermediate regions between the carriages 8, whereby these immediate regions of the endless chains or belts can be readily folded. However, when the bed is again unfolded, these intermediate folded sections of the chains or belts will again readily assume the proper orientation illustrated by FIGS. 6-8.

While the bed as described above is preferably provided with the speed reducer 14, it will be recognized that such speed reducer can be eliminated, if desired, depending upon the speed and type of drive motor utilized.

Further, while FIG. 3 illustrates the use of elongate cylindrical rollers 7 which are of generally uniform diameter, such rollers can obviously assume other shapes and configurations.

Figure 4:
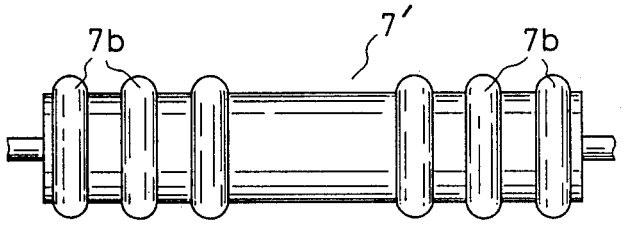
FIG. 4 shows another example of the roller movable around the shaft in the invention.
Figure 5:
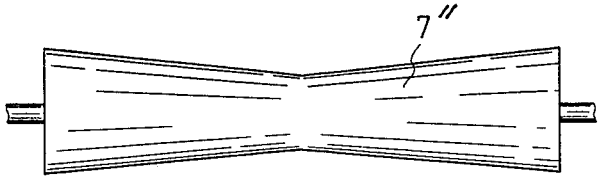
FIG. 5 shows still another example of the roller movable around the shaft in the invention.

For example, as illustrated by FIG. 4, the roller 7' can be provided with several elastic bands 7b mounted thereon and extending therearound at selected axially-spaced locations, if desired, so as to permit different types of massaging action at different locations on the body. Alternately, the roller 7'' can have a configuration similar to that illustrated by FIG. 5 wherein the roller, as viewed axially, is of progressively increasing diameter as it projects axially outwardly in opposite direction from the central plane, thereby providing a shallow trough-like contour which permits the massaging pressure applied to the body to be different along the axial profile of the roller.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A bed-type massaging apparatus, comprising:

a frame including a pair of generally parallel and sidewardly-spaced side rails extending in the longitudinal direction of the apparatus, each of said side rails being split into a pair of elongate first and second rail parts which are normally aligned and have adjacent inner ends joined together by a hinge structure which defines a substantially horizontal hinge axis which extends transversely substantially through the center of the apparatus so that the apparatus can be folded into an upper part and a lower part;

first and second drive shaft respectively disposed adjacent and extending generally transversely between respective said first and second rails parts adjacent the outer ends thereof, each of said shafts having a pair of drive wheels mounted thereon adjacent opposite ends thereof so as to be disposed adjacent opposite sides of the apparatus;

a pair of flexible endless driving elements disposed adjacent opposite sides of the apparatus and respectively engaged with the driving wheels associated with the respective side of the apparatus for drivingly rotatably coupling the first and second shafts together, said endless driving elements including elongate flexible upper and lower reaches which extend generally longitudinally of the apparatus;

a single drive motor, and means drivingly coupling said drive motor to one of said shafts to effect rotational driving thereof;

a first massaging device extending transversely between and movably supported on said first rail parts for movement therealong in the longitudinal direction of the apparatus, and a second massaging device extending transversely between and being movably supported on the second rail parts for movement therealong substantially in the longitudinal direction of the apparatus;

each of said massaging devices including an elongate generally cylindrical roller supported for rotation about a generally horizontal axis which extends transversely of the apparatus, both of said rollers disposed for contacting a body of a user simultaneously, and a pair of support carriers which rotatably support opposite ends of the roller and are respectively longitudinally movably engaged with the respective rail parts; and means for longitudinally moving said first and second massaging devices in opposite directions and for effecting simultaneous massaging of upper and lower portions of the body; comprising first means coupling the support carriers of said first massaging device to the upper reaches of the endless driving elements, and second means coupling the support carriers of said second massaging device to the lower reaches of the endless driving elements, whereby said carriers are simultaneously reciprocated back-and-forth along the respective rail parts in response to energization of the drive motor.

2. An apparatus according to claim 1, including a hold-down roller disposed in engagement with the upper reach of each endless driving element at a location disposed closely adjacent each of the driving wheels.

3. An apparatus according to claim 1, wherein said single drive motor is reversible.

4. An apparatus according to claim 1, wherein the rollers as associated with said first and second massaging devices have upper portions thereof disposed within substantially the same horizontal plane so that the rollers of said first and second massaging devices are disposed for simultaneously contacting the body supported on the apparatus as the first and second massaging devices are simultaneously moved either toward or away from one another.

5. An apparatus according to claim 4, wherein said drive motor is reversible.

* * * * *